United States Patent [19]

Shimoda et al.

[11] Patent Number: 4,473,018

[45] Date of Patent: Sep. 25, 1984

[54] NEEDLE BAR SELECTION DEVICE FOR A MULTIPLE NEEDLE SEWING MACHINE

[75] Inventors: Hiroshi Shimoda, Toyota; Yutaka Kato, Kariya, both of Japan

[73] Assignee: Aisin Seiki Kabushiki Kaisha, Kariya, Japan

[21] Appl. No.: 532,936

[22] Filed: Sep. 16, 1983

[30] Foreign Application Priority Data

Sep. 16, 1982 [JP] Japan ..... 57-161282

[51] Int. Cl.[3] ..... D05B 55/10

[52] U.S. Cl. ..... 112/163

[58] Field of Search ..... 112/163, 98, 167, 221

[56] References Cited

U.S. PATENT DOCUMENTS 3,481,291 12/1969 Schilling ..... 112/98
3,884,165 5/1975 Tajima ..... 112/221 X
4,301,756 11/1981 Teetz et al. ..... 112/221

*Primary Examiner*—Werner H. Schroeder
*Assistant Examiner*—Andrew M. Falik
*Attorney, Agent, or Firm*—Sughrue, Mion, Zinn, Macpeak & Seas

[57] ABSTRACT

A sewing machine wherein a plurality of needle bars are supported by a single needle bar supporting arm. The supporting arm is made movable across a sewing line of the sewing machine, and one of the needle bars is driven by a main drive shaft of the sewing machine. A safety device is provided for preventing the main drive shaft from being rotated while the needle bar supporting arm is moved across the sewing line.

2 Claims, 9 Drawing Figures

NEEDLE BAR SELECTION DEVICE FOR A MULTIPLE NEEDLE SEWING MACHINE

BACKGROUND OF THE INVENTION

1. Field of the Invention

This invention relates to a sewing machine, and more particularly to a multi-needle bar sewing machine including a needle bar transfer device and a safety device.

2. Description of the Prior Art

Ordinarily, a sewing machine wherein a plurality of needle bars are supported by a needle bar supporting arm and only one of the needle bars is driven by a main drive shaft (or arm shaft) is so constructed that the needle bar supporting arm is made movable in a transverse direction to the sewing line, and a projection at an end of the crank rod is brought into engagement with one of the recesses formed in the needle bars.

In the sewing machine of the above described construction, however, if the main drive shaft is accidentally rotated while the needle bars are transferred between each other, hazardous conditions of damaging the needle and the needle plate and hurting the operator tend to occur.

SUMMARY OF THE INVENTION

A primary object of the present invention is to provide a sewing machine wherein the above described difficulties can be substantially eliminated.

Another object of the invention is to provide a sewing machine wherein a safety device is further provided for preventing the rotation of the main drive shaft during the shift of the needle bar supporting arm.

According to the present invention, not only the occurrence of the hazardous conditions can be eliminated by preventing the rotation of the main drive shaft (or arm shaft) during the transfer of the needle bars, but also the safety device is so interlinked with the needle bar transfer device that the safety device can be put into operation or released simultaneous with the start and stop of the needle bar transfer device.

DESCRIPTION OF THE PREFERRED EMBODIMENT

Figure 1:
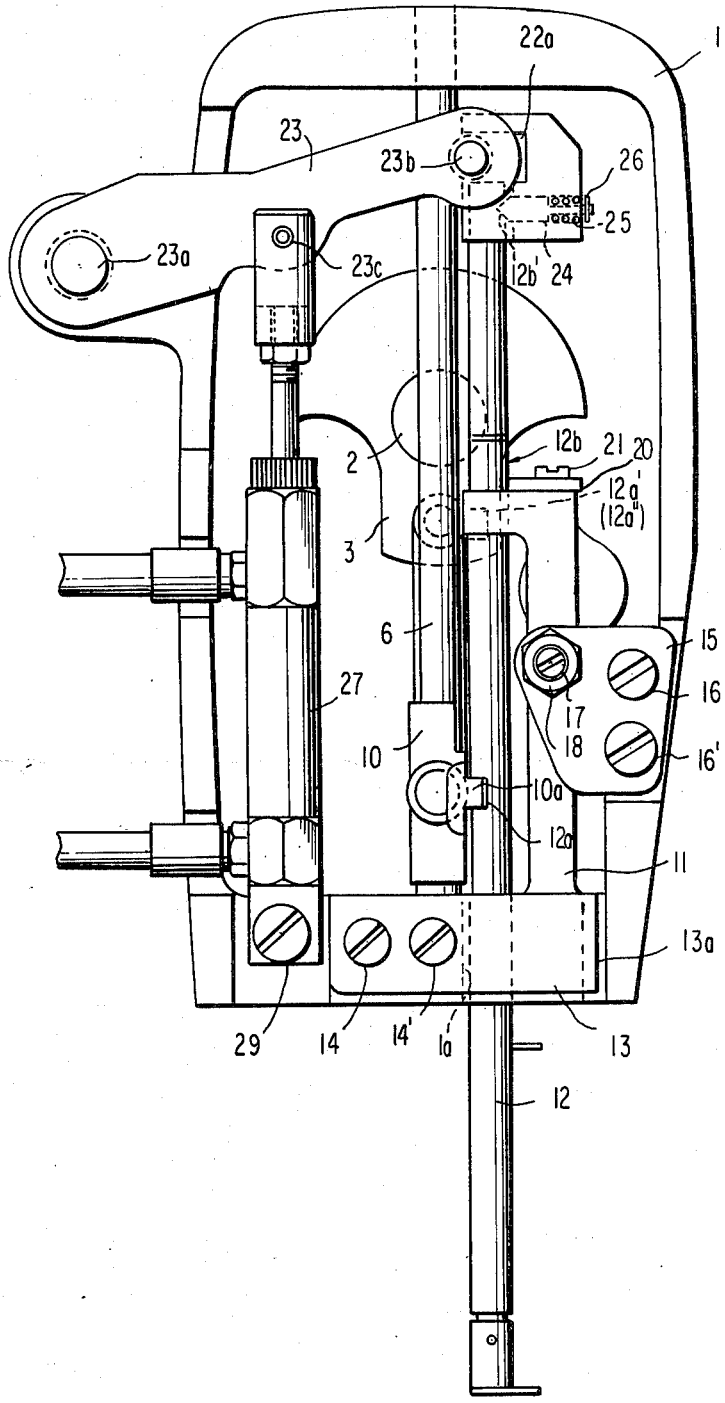
FIG. 1 is a front view, with the face plate removed, showing a sewing machine according to the present invention.

A preferred embodiment of the present invention will now be described in detail with reference to the accompanying drawings.

A sewing machine constituting a preferred embodiment of the invention comprises an upper portion of housing hereinafter termed simply an arm 1, a main drive shaft (or arm shaft) 2 passing through the arm 1, a crank 3 coupled to an end of the main drive shaft 2, a crank rod 5 movably extending from the crank 3, and a guide bar 6 fixed to the arm 1 for slidably mounting a sliding member 8. The sliding member 8 includes a shaft portion 8*a* rotatably coupled with the lower end of the crank rod 5. A rectangular piece 9 rotatably mounted at an end of the shaft portion 8*a* is inserted in a sliding engagement in a vertical groove provided in the arm 1. Thus when the main driving shaft 2 is rotated, the end portion 10 of the crank rod 5 is moved upward and downward relative to the guide bar 6 together with the sliding member 8.

A plurality of needle bars 12, 12' and 12'' are supported arm 11. For restricting the right and leftmovement (as viewed in FIG. 1) of the lower part of the arm 11, the part is placed between a structural surface 1*a* formed in the arm 1 and an internal surface of a bent portion 13*a* of a guide member 13 that is secured to the arm 1 by means of screws 14 and 14'. The movement of the needle bar supporting arm 11 in a direction perpendicular to the cloth feeding direction of the sewing machine is defined leftwardly by a stopper 17 which is secured to a stopper plate 15 in an adjustable manner by means of a nut 18, and rightwardly by an adjustable screw 19 driven into the arm 1.

The needle bars 12, 12' and 12'' are provided with recesses 12*a*, 12*a'* and 12*a''* engageable with the projection 10*a* of the above described rod end 10. Furthermore, the needle bars 12, 12' and 12'' are provided with circumferential grooves 12*b*, 12*b'* and 12*b''*, and also elongated plannar surfaces 12*c*, 12*c'* and 12*c''* formed on the opposite side of the recesses 12*a*, 12*a'* and 12*a''*, respectively, for restricting the rotation of the needle bars. More specifically, the surfaces 12*c*, 12*c'* and 12*c''* are brought into engagement with rotation restricting plates 20, 20' and 20'' secured to the upper surface of the needle bar supporting arm 11 by means of screws 21, 21' and 21'', respectively.

Numeral 22 designates a needle bar holding member which is provided with holes 22*b*, 22*b'* and 22*b''* for holding the needle bars at the circumferential grooves 12*b*, 12*b'* and 12*b''*, and also a recess 22*a* for receiving a shaft 23*b* extending from a needle bar descending plate 23 which is swingably supported at an end 23*a* thereof by the arm 1. Stepped pins 24, 24' and 24'', springs 25 for urging the stepped pins toward the circumferential grooves of the needle bars 12, 12' and 12'', and rings 26, 26' and 26'' for restricting the strokes of the pins 24, 24' and 24'' are provided for the holes 22*b*, 22*b'* and 22*b''*, respectively.

A needle bar descending device 27 (a pneumatic cylinder in the shown example) which is operated under the control of a switch described hereafter is swingably attached at an upper end thereof to an intermediate position of the needle bar descending plate 23. The lower end of the descending device 27 is secured to the arm 1 by a screw 29.

A needle bar transfer shaft 30 is extended across the arm 1 in a direction perpendicular to the main drive shaft 2 so that the shaft 30 is rotatable around and slidable along the center line of the shaft 30. A dial member 31 is secured to one end of the shaft 30 by a set screw 33, and is urged rightwardly as viewed in FIG. 4 by a spring 32. The other end of the shaft 30 extends leftwardly in excess of a needle bar transfer plate 35 which is secured to the arm 1 by a screw 34, and a needle bar transfer arm 36 is secured to the end of the shaft 30 by a set screw 37. Under the force of the spring 32, the arm 36 secured to the second mentioned end of the shaft 30 is ordinarily held in a sliding contact with the plate 35, while a gap l is ordinarily maintained between the rear side surface of the dial member 31 secured to the first mentioned end of the shaft 30 and the outer surface of the arm 1.

Through the transfer arm 36, pins 38 and 38' are extended toward the transfer plate 35 with the extended lengths adjusted by set screws 39 and 39', respectively. On the other hand, radially elongated holes 35*a* and 35*a'* are provided through the transfer plate for receiving either one of the pins 38 and 38', while arcuate escape holes 35*b* and 35*b'* are provided therethrough for receiving either one or both of the pins 38 and 38' in accordance with the rotation of the shaft 30. On the transfer plate 35, there are further provided stoppers 40 and 40' which are made adjustable by nuts 41 and 41', respectively, so that the rotating range of the transfer arm 36 is thereby adjusted suitably.

A bifurcated member 42 having a projection 42*a* at an intermediate position and a bifurcated portion 42*b* at the distal end thereof is fixedly mounted on the shaft 30 by means of a screw 43. The projection 42*a* is brought into a position opposite to an axially elongated recess 45*a* formed on a stopper 45 which is by a set screw 44 fixedly mounted on the main drive shaft 2 in a predetermined angular relation. When the shaft 30 is moved axially, the projection 42*a* is brought into engagement with the recess 45*a*.

Figure 2:
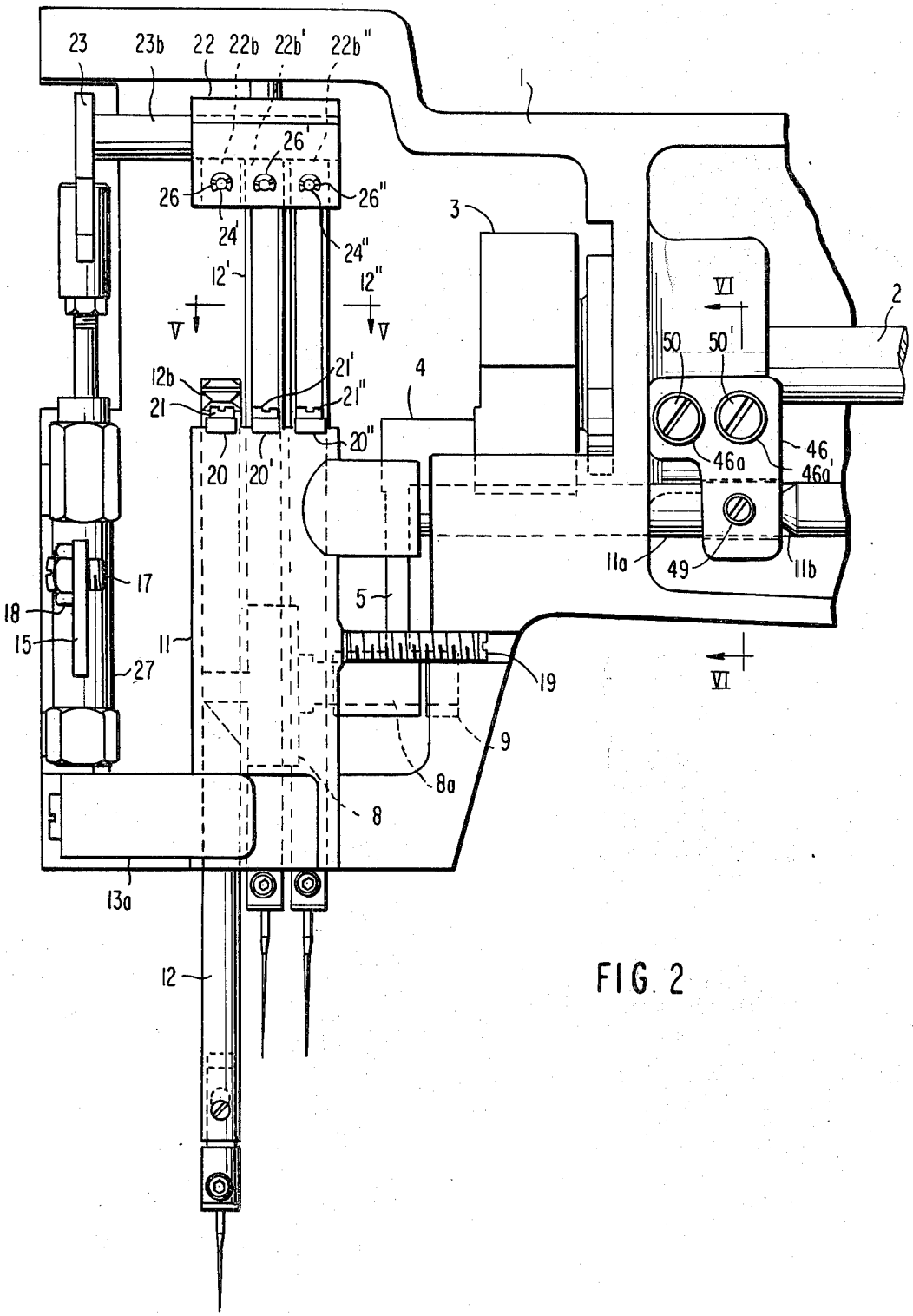
FIG. 2 is a profile view of the sewing machine shown in FIG. 1.
Figure 3:
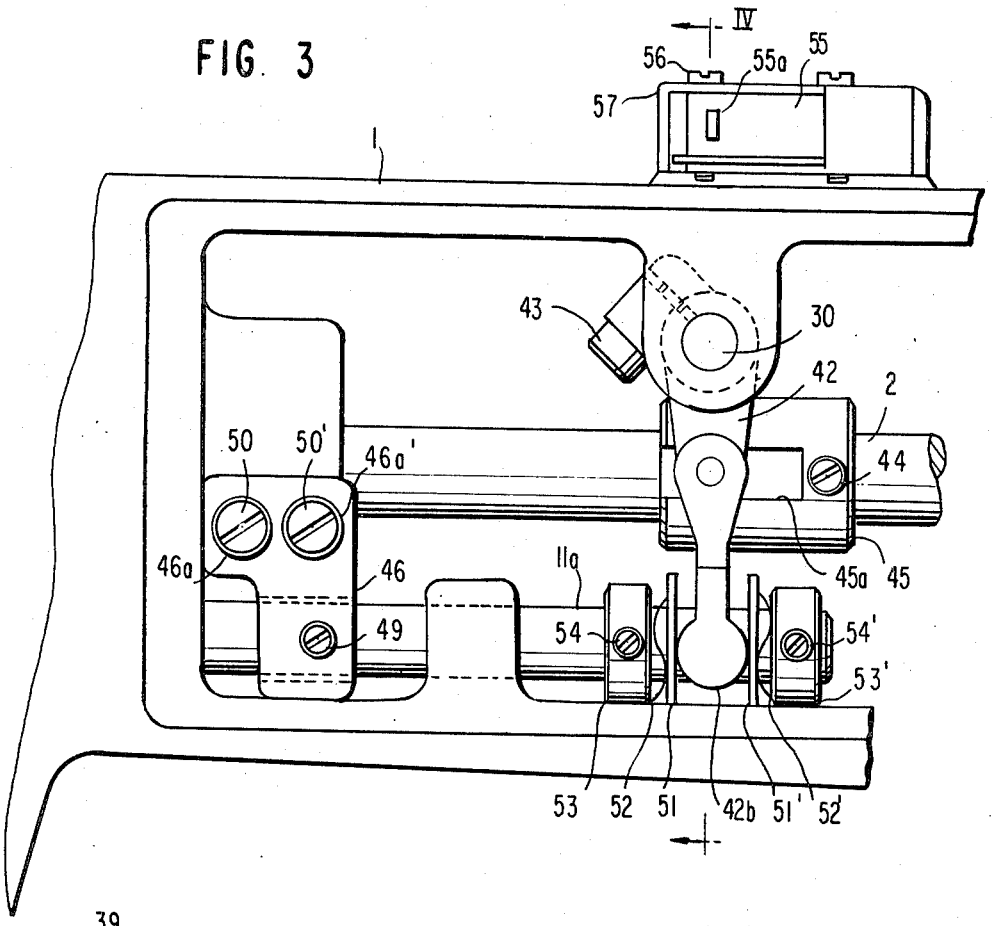
FIG. 3 is a front view of a needle bar transfer device provided in the sewing machine of this invention.
Figure 6:
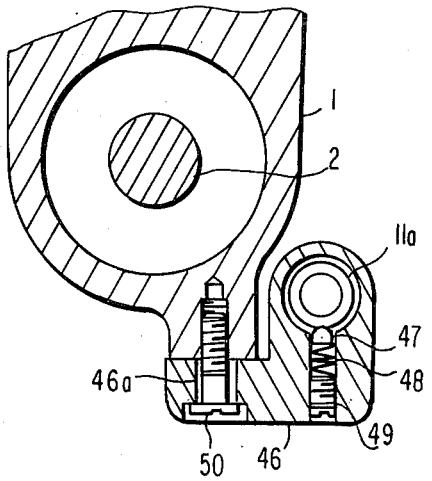
FIG. 6 is a sectional view along the line VI—VI in FIG. 2.

As will be apparent from FIGS. 2 and 3, the needle bar supporting arm 11 has a shaft portion 11*a* extending in parallel with the main drive shaft 2 so that the shaft portion 11*a* is placed between two legs of the bifurcated portion 42*b* of the member 42. In an intermediate inspection portion of the arm 1, the shaft portion 11*a* is passed through a positioning holder 46 secured to the arm 1. In the positioning holder 46, a steel piece 47 is urged by a spring 48 and a screw 49 into a V-shaped groove 11*b* formed on the surface of the shaft portion 11*a* so that the positioning of the needle bar supporting arm 11 is thereby achieved (see FIG. 6). The positioning holder 46 is secured to the arm 1 by means of screws 50 and 50' inserted through oversized (or elongated) holes 46*a* formed in the holder 46 such that the secured position of the holder 46 is finely adjustable along the axial direction of the shaft portion 11*a*.

Furthermore, on both sides of the bifurcated portion 42*b* (of a circular configuration) of the bifurcated member 42, collars 53 and 53' are secured to the shaft portion 11*a* of the needle bar supporting arm 11, with washers 51 and 51' and resilicent members 52 and 52' interposed between the portion 42*b* and the two collars.

Numeral 55 designates a switch that is secured to a switch holder 57 by means of screws 56 and 56'. The switch holder 57 is in turn secured to the arm 1 by a screw 58. The switch 55 includes an operating member 55*a*. When the dial member 31 is displaced leftward as viewed in FIG. 4, the bifurcated member 42 mounted on the transfer shaft 30 is moved leftward so that the projection 42*a* of the bifurcated member 42 enters in engagement with the elongated recess 45*a* of the stopper 45, while a base portion of the dial member 31 depresses the operating member 55*a* of the switch 55 into ON state. The ON state of the switch 55 operates the needle bar descending device (pnuematic cylinder) 27.

The above described operation, however, is realized only when the main drive shaft 2 stops at a predetermined angular position, and at other positions the displacement of the dial member 31 and hence the depression of the switch 55 are made impossible by the abutment of the projection 42*a* to the outer surface of the stopper 45 thereby leaving the needle bar descending device 27 in an inoperative state.

The operation of the preferred embodiment of the invention will now be described.

Figure 7:
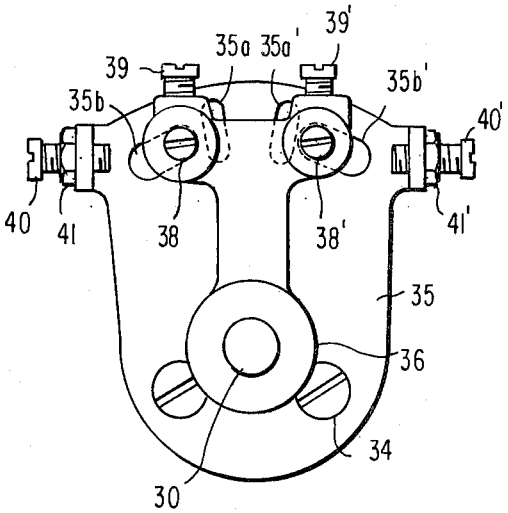
FIGS. 7 and 8 are a front view and a rear view of a needle bar transfer plate provided in the sewing machine of this invention.
Figure 8:
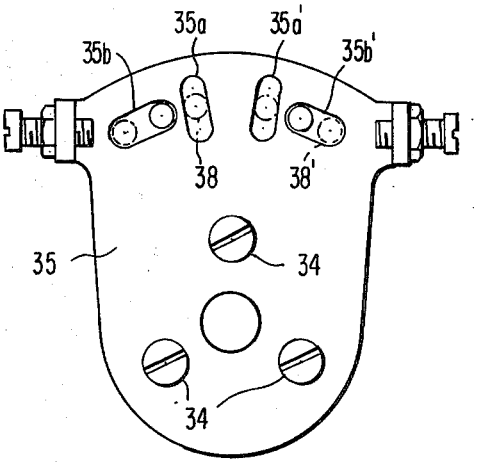

In a sewing machine having a recently developed needle bar stop position determining device, when the operation of the sewing machine is stopped, the crank rod 5 and hence the rod end 10 are brought into positions shown in FIG. 1 (corresponding to the upper dead point of a thread take-up lever) by the needle bar stop position determining device (not shown) which is operated electrically. In the state shown in FIGS. 1 and 2, the leftward needle bar 12 is selected, so that other needle bars 12' and 12'' are held in their upper positions by the stepped pins 24' and 24'' which engage the circumferential grooves 12*b'* and 12*b''* of the needle bars 12' and 12'', respectively. In this state, the pin 38 of the transfer arm 36 engages with the radially elongated hole 35*a*, while the pin 38' of the arm 36 engages with the arcuate escape hole 35*b'* formed through the transfer plate 35 on the right side in FIG. 7.

When it is desired to transfer the needle bar, for instance, from the needle bar 12 to the needle bar 12' located at the center, the dial member 31 (in FIG. 4) is firstly depressed from the position shown by a solid line to the position shown by a dotted line. Thus, the projection 42*a* of the bifurcated member 42 mounted on the transfer shaft 30 is placed in the elongated recess 45*a* of the stopper 45, and the pins 38 and 38' projecting from the transfer arm 36 are disengaged from the radially elongated hole 35*a* and the arcuate escape hole 35*b'*, respectively. Simultaneously, the operative member 55*a* of the switch 55 is depressed by the base portion of the dial member 31 so that the switch 55 is brought into ON state. As a consequence, the pneumatic cylinder 27 is operated to rotate the descending plate 23 clockwisely as viewed in FIG. 1 around the pivotal point 23*a*.

Figure 9:
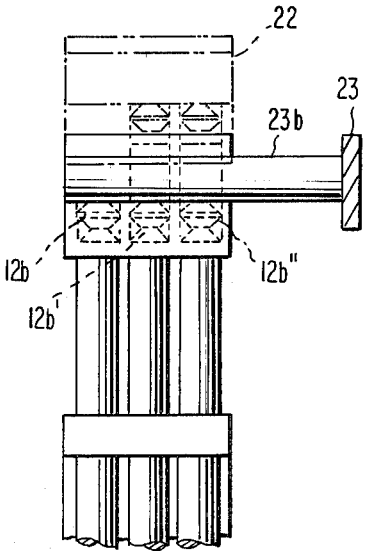
FIG. 9 is a profile view showing upper part of needle bars for explaining the operation of the same.

Thus, the needle bar holding member 22 engaging with the shaft portion 23*b* of the descending plate 23 is brought down from the position shown by a two dot chain line to the position shown by a solid line in FIG. 9, so that the circumferential groove 12*b* of the needle bar 12 is brought into engagement with the stepped pin 24 in the needle bar holding member 22.

Figure 4:
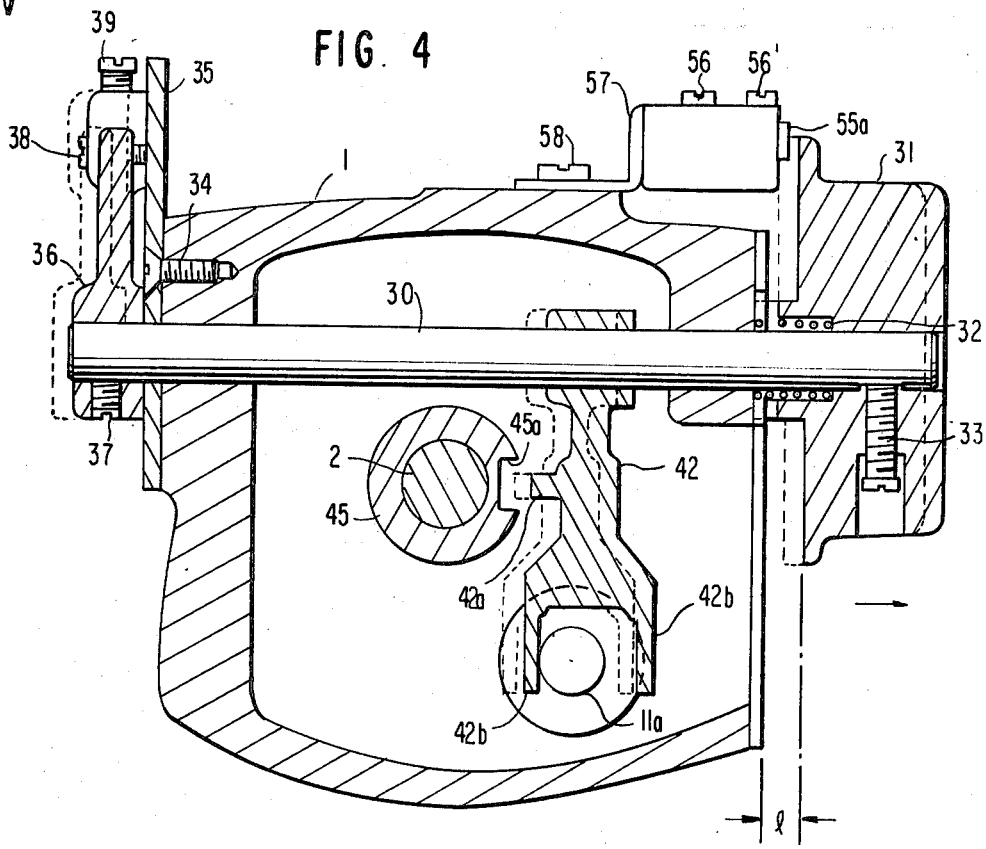
FIG. 4 is a sectional view along the line IV—IV in FIG. 3.
Figure 5:
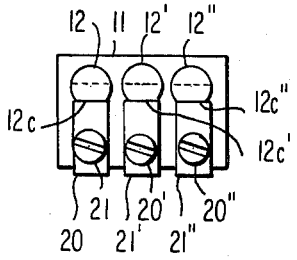
FIG. 5 is a sectional view along the line V—V in FIG. 2.

When the dial member 31 is then rotated clockwisely as viewed from the right side of FIG. 4, the shaft portion 11*a* of the needle bar supporting arm 11 is shifted leftwardly as viewed in FIG. 3 by the bifurcated portion 42*b* (of a circular configuration) of the bifurcated member 42, so that the steel ball 47 provided in the positioning holder 46 engages the V shaped groove 11*b* of the shaft portion 11*a*. At this time the transfer arm 36 is located at a position where the pins 38 and 38' projecting from the transfer arm 36 engage two arcuate escape holes 35*b* and 35*b'* formed through the transfer plate 35, respectively. Since the transfer shaft 30 is urged by the spring 32 rightwardly as viewed in FIG. 4, the dial member 31, bifurcated member 42 and the transfer arm 36 are brought back to their original positions indicated by solid lines in FIG. 4 after the completion of the engagement between the steel ball 47 and the V shaped groove 11*b* and the rotation of the transfer arm 36 into the position shown in FIG. 7.

The needle bars 12, 12' and 12" having been aligned into same height and the recesses 12*a*, 12*a'* and 12*a"* having been aligned horizontally as shown in FIG. 9 are thus shifted leftwardly as viewed in FIG. 2 in accordance with the leftward movement of the needle bar supporting arm 11, and the projection 10*a* of the rod end 10 is disengaged from the recess 12*a* of the needle bar 12 and brought into engagement with the recess 12*a'* of the needle bar 12'.

Furthermore, the switch 55 is brought into OFF state by the retraction of the base portion of the dial member 31 away from the operative member 55*a*. The pneumatic cylinder 27 is thus made inoperative, and the descending plate 23 and the needle bar holding member 22 are sent back to their original positions. By the upward movement of the needle bar holding member 22, the needle bars 12 and 12", whose circumferential grooves 12*b* and 12*b"* are engaged with the stepped pins 24 and 24" in the member 22, are moved upward together with the member 22. In this case, since the recess 12*a'* of the needle bar 12' is brought into engagement with the projection 10*a* of the rod end 10, the needle bar 12' is held in its downward position with the circumferential groove 12*b'* thereof disengaged out of the stepped pin 24'.

In the present invention, needle bars are transferred according to a series of operations as described above. When it is desired to select a needle bar 12" on the right side, similar operations may be followed except that the pin 38' of the transfer arm 36 is engaged with the radially elongated hole 35*a'* of the transfer plate 35 and the steel ball 47 is disengaged from the V shaped groove 11*b*.

As will be apparent from the above description, the V shaped groove 11*b* on the shaft portion 11*a* to be engaged with the steel ball 47 of the positioning holder 46 is provided only for the needle bar 12' of the middle position which is assumed to be a reference needle bar for the transfer operation. Other needle bars may be selected by rotating the dial member 31 as desired.

What is claimed is:

1. A sewing machine comprising: a main drive shaft; a plurality of needle bars; a needle bar supporting arm for supporting the needle bars in such a manner that the needle bars are movable vertically; means operatively coupled with said main drive shaft so as to be engageable with one of said needle bars; means for holding needle bars which are disengaged from said engageable means into inoperative positions; descending means for lowering needle bars in said inoperative positions into alignment at a height equal to that of the single needle bar engaged with the engageable means, means for moving said needle bar supporting arm across a sewing line when entire needle bars are aligned at the height, and a safety device for blocking the rotation of said main drive shaft during the movement of said needle bar supporting arm.

2. A sewing machine as set forth in claim 1 wherein said safety device comprises a stopper having an elongated recess secured to said main drive shaft; and a member movable toward the stopper during the movement of said needle bar supporting arm, said member having a projection engageable with said elongated recess.

* * * * *